US007967656B2

(12) United States Patent
Hu

(10) Patent No.: US 7,967,656 B2
(45) Date of Patent: Jun. 28, 2011

(54) MULTI-PURPOSE MODULAR UNIT

(76) Inventor: Teng-Fu Hu, Taichung (TW)

( * ) Notice: Subject to any disclaimer, the term of this patent is extended or adjusted under 35 U.S.C. 154(b) by 217 days.

(21) Appl. No.: 12/404,297

(22) Filed: Mar. 14, 2009

(65) Prior Publication Data

US 2009/0239441 A1 Sep. 24, 2009

(30) Foreign Application Priority Data

Mar. 21, 2008 (TW) ..... 97204850 U

(51) Int. Cl.
*A63H 33/08* (2006.01)
*A63H 33/10* (2006.01)

(52) U.S. Cl. ..... 446/123; 446/124

(58) Field of Classification Search ..... 446/102, 446/104, 111, 122, 123, 124, 125, 144; 273/153 R, 273/156, 160; 434/260, 401, 403
See application file for complete search history.

(56) References Cited

U.S. PATENT DOCUMENTS 3,355,837 A * 12/1967 Pedersen ..... 446/94
4,589,853 A * 5/1986 Hidvegi ..... 446/123
4,620,747 A * 11/1986 Lemmon ..... 297/440.1
5,152,530 A * 10/1992 Dodek, II ..... 273/156
6,460,850 B1 * 10/2002 Dodek, II ..... 273/156

* cited by examiner

*Primary Examiner* — Nini Legesse
(74) *Attorney, Agent, or Firm* — Egbert Law Offices PLLC

(57) ABSTRACT

The present invention provides a multi-purpose modular unit, including multiple blocks and adapters. The blocks are provided with multiple side faces and embedded tap holes. The adapters are screwed into the corresponding tap holes of two adjacent blocks. With this adapter, the blocks can be interlocked and assembled as furniture, stationery and toys that can be easily assembled or disassembled depending on various configurations and functions.

8 Claims, 11 Drawing Sheets

MULTI-PURPOSE MODULAR UNIT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a modular unit, and more particularly to a multi-purpose one which can be assembled into shapes.

2. Description of Related Art Including Information Disclosed Under 37 CFR 1.97 and 37 CFR 1.98.

Notwithstanding that common building blocks can be assembled into toys and stationery objects of different shapes, the poor binding strength of these prior art building blocks, arising from interlocking of tenons and grooves, may make it difficult to support larger bearing capacity. Thus, functions of the prior art building blocks are highly restricted.

Moreover, existing building blocks are assembled in a fixed direction without any angular change, leading to the inflexibility in applications.

BRIEF SUMMARY OF THE INVENTION

As a tap hole is laterally arranged on the blocks for insertion of the adapter 110 and hinged arm 130, blocks can be assembled flexibly in various configurations and directions.

The blocks of different patterns can be mated with each other at any angle, thus increasing the flexibility of configuration.

The adapter 110 can be adjusted at any angle and then locked securely after positioning, thereby increasing the angular change and flexibility of configuration.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
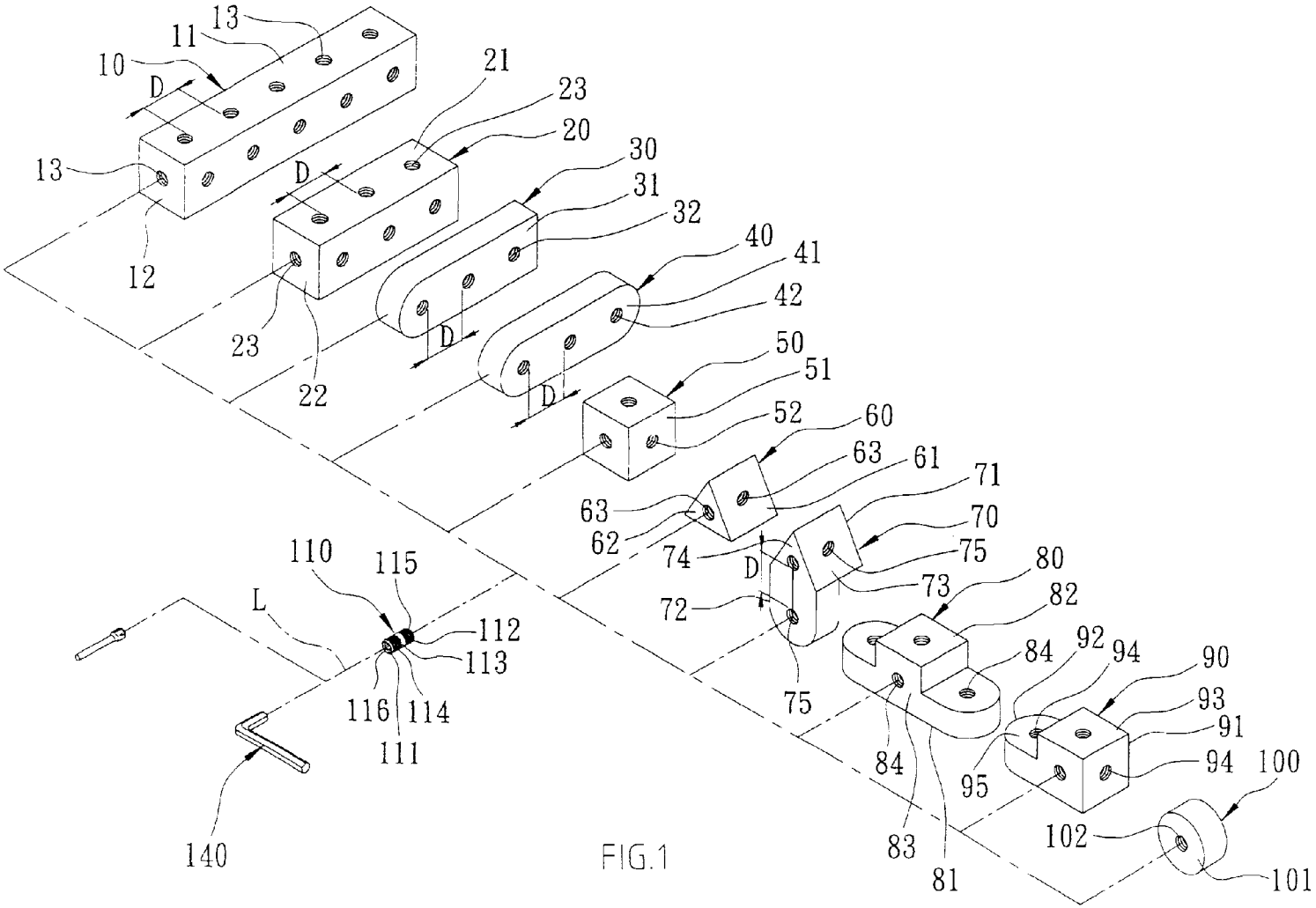
FIG. 1 shows a partially exploded perspective view of the present invention, showing the preferred embodiment of the multi-purpose modular unit of the present invention.
Figure 2:
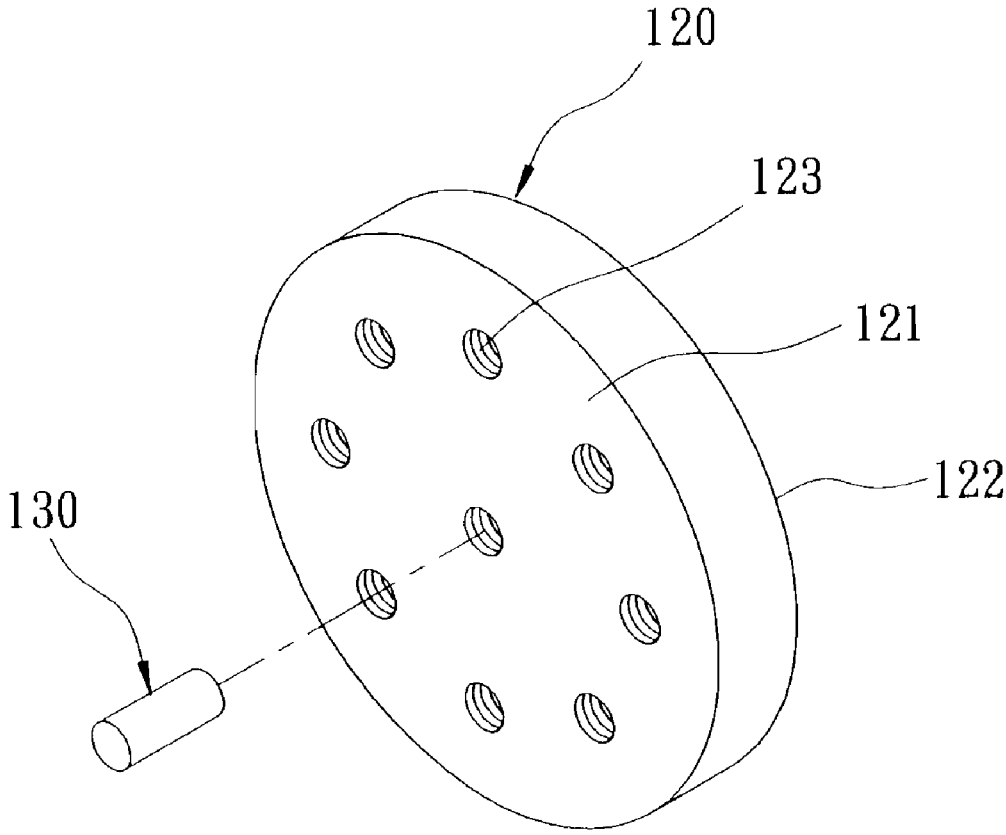
FIG. 2 shows another partially exploded perspective view of the preferred embodiment of the present invention.

FIG. 1-2 depict preferred embodiments of the multi-purpose modular unit of the present invention, where it comprises a first block 10 like rectangular long-column, a second block 20 like rectangular short-column, a third block 30 like arched-type board, a fourth block 40 like elliptical board, a fifth block 50 like square board, a sixth block 60 like triangular board, a seventh block 70 like triangular composite arched board, a T-type eighth block 80, an L-type ninth block 90, a tenth block 10 like short cylinder, an adapter 110, a disk 120, a hinged arm 130 assembled within the disk 120, and an operating tool 140 used to operate this adapter 110.

The first block 10 is provided with 4 first long-side faces 11 interconnected perpendicularly and two square faces 12 arranged separately at both sides of the first long-side face 11. The first long-side face 11 is provided with 5 tap holes 13 arranged at equal interval. A distance D is formed between two adjacent tap holes 13 on the same first long-side face 11. A tap hole 13 is also arranged separately on the square face 12. The tap holes 13 embedded on two oppositely arranged first long-side faces 11 are placed coaxially and interlinked, whilst the tap holes 13 embedded between the vertically connected first long-side face 11 and square face 12 are linked perpendicularly.

The second block 20 is provided with 4 second long-side faces 21 interconnected perpendicularly and two square faces 22 arranged separately at both sides of the second long-side face 21. The second long-side face 21 is provided with 3 tap holes 23 arranged at equal intervals. A distance D is formed between two corresponding edges of two adjacent tap holes 23 on the same second long-side face 21. The tap holes 23 embedded on the square faces 22 are placed coaxially and interlinked, whilst the tap holes 23 embedded between the vertically connected second long-side face 21 and square face 22 are linked perpendicularly.

The third block 30 is provided with 2 arched side faces 31 arranged oppositely in parallel. Three tap holes 32 of equal spacing are arranged separately on the arched side face 31. Moreover, a distance D is formed between two corresponding edges of two adjacent tap holes 32 on the same arched side face 31, whilst the tap holes 32 on the arched side face 31 are placed coaxially and interlinked.

The fourth block 40 is provided with 2 elliptical side faces 41 arranged oppositely in parallel. Three tap holes 42 of equal spacing are arranged separately on the elliptical side face 41. Moreover, a distance D is formed between two corresponding edges of two adjacent tap holes 42 on the same elliptical side face 41. The tap holes 42 of the elliptical side face 41 are placed coaxially and interlinked. And, the block 40 can be extended into fourth block 40B with two tap holes.

This fifth block 50 is provided with 6 short side faces 51 interlinked perpendicularly, each of which has a tap hole 52. The two tap holes 42 on two opposite short side faces 51 are placed coaxially and interlinked, whilst the tap holes 52 on two vertical short side faces 51 are linked perpendicularly. When the fifth block 50 and other blocks are adjoined, a distance D is formed between two corresponding edges of two adjacent tap holes on the parallel side faces.

The sixth block 60 is provided with 3 interlinked oblique side faces 61 and three triangular side faces 62 oppositely and separately arranged on both sides of the oblique side face 61. A tap hole 63 is placed separately on the oblique side face 61 and the triangular side face 62.

The seventh block 70 is provided with a triangular portion 71 and an arched portion 72 connected with the triangular portion 71. The triangular portion 71 is provided with two oblique side faces 73 of an included angle 60°, and two tap holes 75 on the triangular side face 74 oppositely arranged on both sides of the oblique side face 73. The arched portion 72 is also provided with a tap hole 75 that forms a distance D with the tap hole 75 on the triangular side face 73.

The eighth block 80 is provided with a plain side face 81, a stepped side face 82 oppositely arranged with the plain side face 81, and a circular side face 83 between the plain side face 81 and stepped side face 82. Both the plain side face 81 and stepped side face 82 are fitted with 3 tap holes 84 at equal interval. The spacing between the corresponding edges of two adjacent tap holes 84 is equal to the distance D. The circular side face 83 is also provided with a tap hole 84 placed centrally. The tap holes 84 embedded on the oppositely arranged plain side face 81 and stepped side face 82 are placed coaxially and interlinked, whilst the tap holes 84 embedded on the vertically linked circular side face 83 are linked perpendicularly.

The ninth block 90 is provided with a square portion 91 and an arched portion 92. The square portion 91 is provided with 6 vertically linked square side faces 93. The square side face 93 not linked to the arched portion 92 is provided with a tap hole 94. The arched portion 92 is provided with 2 arched side faces 95 arranged oppositely in parallel, each of which is fitted with an interlinked tap hole 94.

The tenth block 100 is provided with 2 round side faces 101 arranged oppositely in parallel; an interlinked tap hole 102 is placed on the center of the round side face 101.

The adapter 110 like a lever is provided with a first end 111, a second end 112 arranged oppositely with the first end 111 along axial line L, an intermediate portion 113 between the first and second ends 111, 112, a first threaded portion 114 arranged on one side of the intermediate portion 113 correspondingly to the first end 111, a second threaded portion 115 arranged on the other side of the intermediate portion 113 correspondingly to the second end 112, as well as 2 hexagonal holes 116 embedded separately onto the first and second ends 111, 112 along the axial line L. The threads of the first and second threaded portions 114, 115 are screwed oppositely, so that they can be screwed separately into two corresponding tap holes of two adjoining blocks. Moreover, the length extending from the first end 111 to the second end 112 is smaller than the distance D.

The disk 120 is provided with a first face 121, a second face 122 arranged opposite to the first face 121, and many tap holes 123 penetrating from the first face 121 to the second face 122. Such a block can be connected with the disk 120 via the adapter.

The hinged arm 130 can be rotatably inserted into the tap hole 123 of the disk 120, or into the tap hole of the aforementioned blocks.

The operating tool 140 of the preferred embodiment is an L-shaped or straight hexagonal wrench, which can be inserted into the hexagonal hole 116 of the adapter 110.

Figure 3:
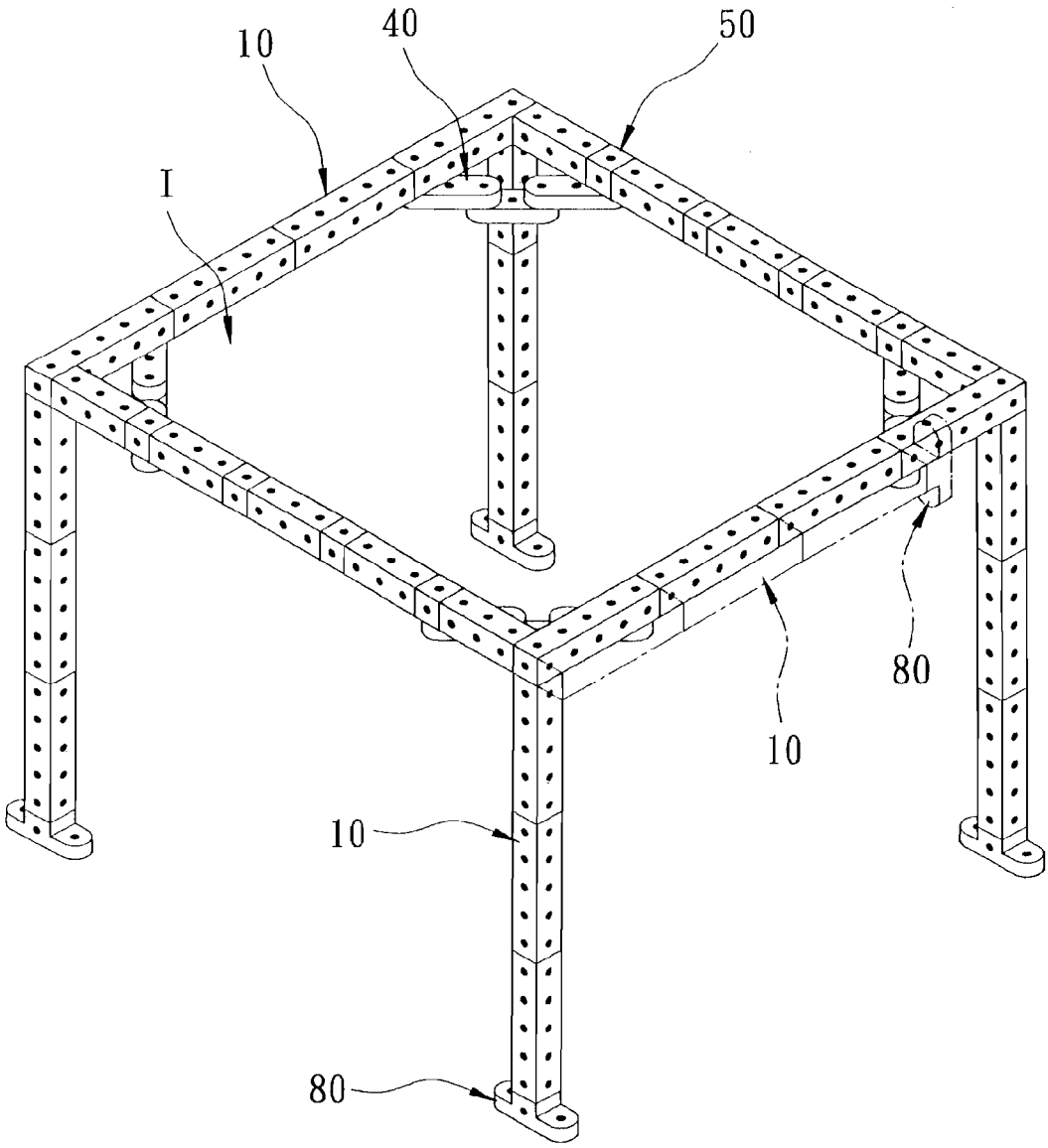
FIG. 3 shows an assembled perspective view of the preferred embodiment of the present invention, showing a table that can be assembled.

Referring to FIGS. 1-2, the blocks can be assembled as various goods where required. Referring to FIG. 3, multiple first blocks 10 and fifth blocks 50 can be assembled as a table-like framework using the adapter 110, multiple fourth blocks 40 are pin-jointed into the hinged portion of the table-like framework, and a space with open top is formed within this framework, so it can be used if a board is embedded into this space I. In case multiple first blocks 10 and eighth blocks 80 are assembled as four table legs by the easy-to-operate adapter 110, these table legs can be easily removed from the bottom of the table, or fixed laterally onto the table during storage, handling and packaging. Therefore, a table of practicability can be assembled from the combination of the blocks of the present invention.

Figure 7:
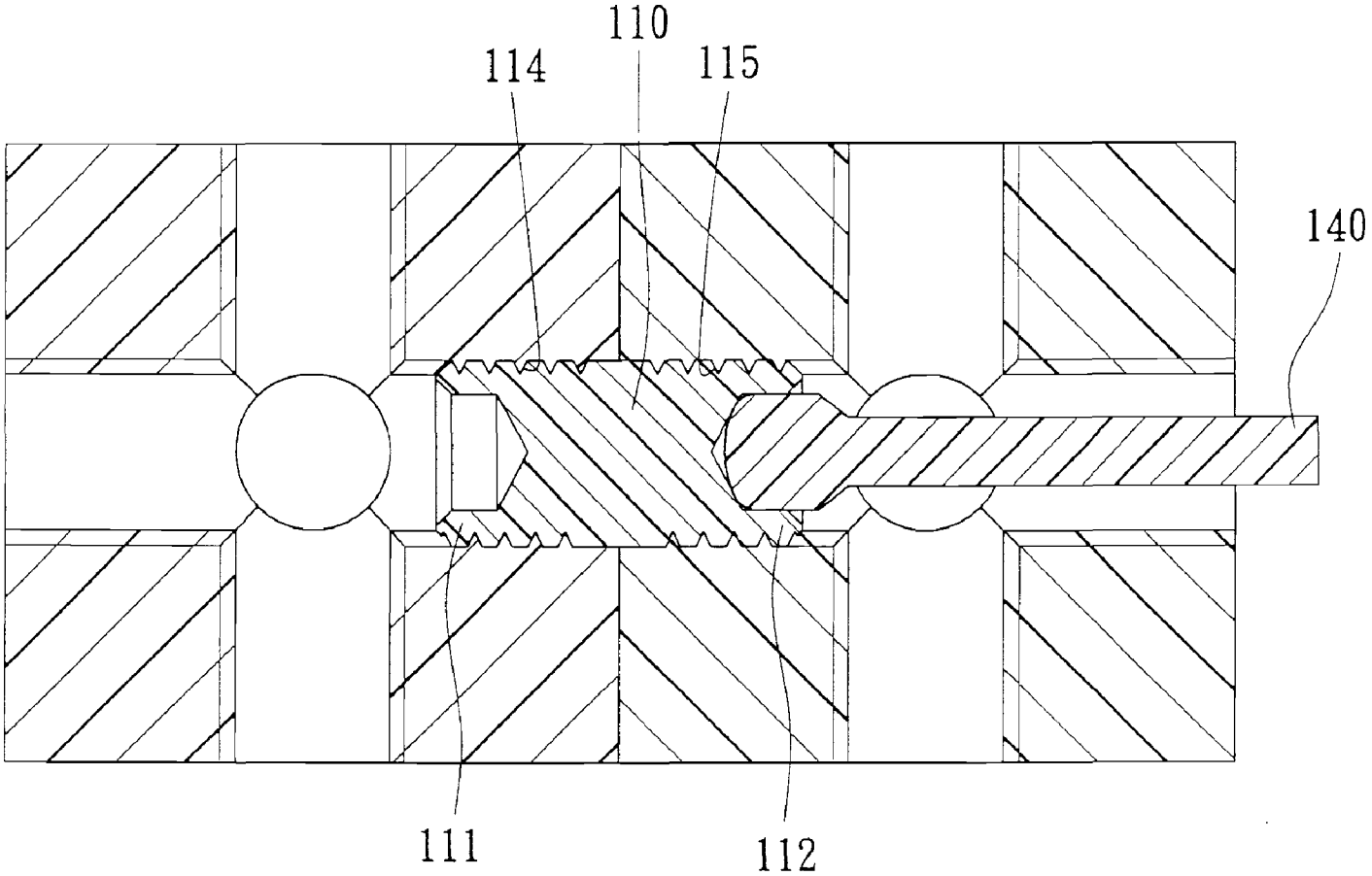
FIG. 7 shows a cross-sectional view of the preferred embodiment of the present invention that an adapter is used to link the blocks.

Referring to FIG. 7, based on the design that the first and second threaded portions 114, 115 of the adapter 110 are screwed oppositely, two blocks can be easily mated with or separated from each other when the operating tool 140 is used to rotate the first end 111 or second end 112 of the adapter 110.

Figure 4:
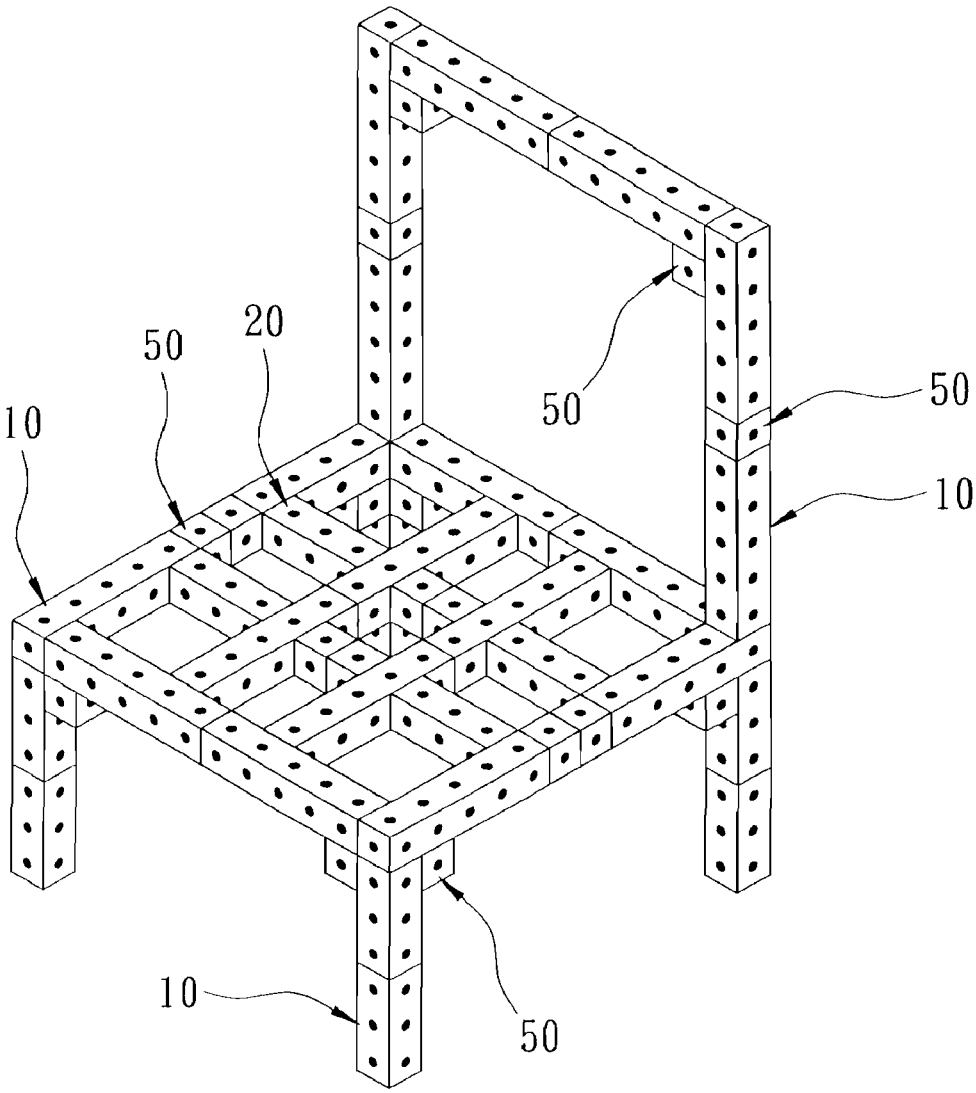
FIG. 4 shows another assembled perspective view of the preferred embodiment of the present invention, showing a chair that can be assembled.

Referring to FIG. 4, with the design of the adapter 110, multiple first blocks 10, second blocks 20 and fifth blocks 50 are assembled as a chair panel, then multiple second blocks 10 assembled as four chair legs, multiple first blocks 10 and fifth blocks 50 assembled as a chair back, and multiple fifth blocks 50 assembled on the joint of the chair panel and leg for reinforcement. Therefore, a chair of practicability can be assembled from the combination of the blocks of the present invention.

Figure 5:
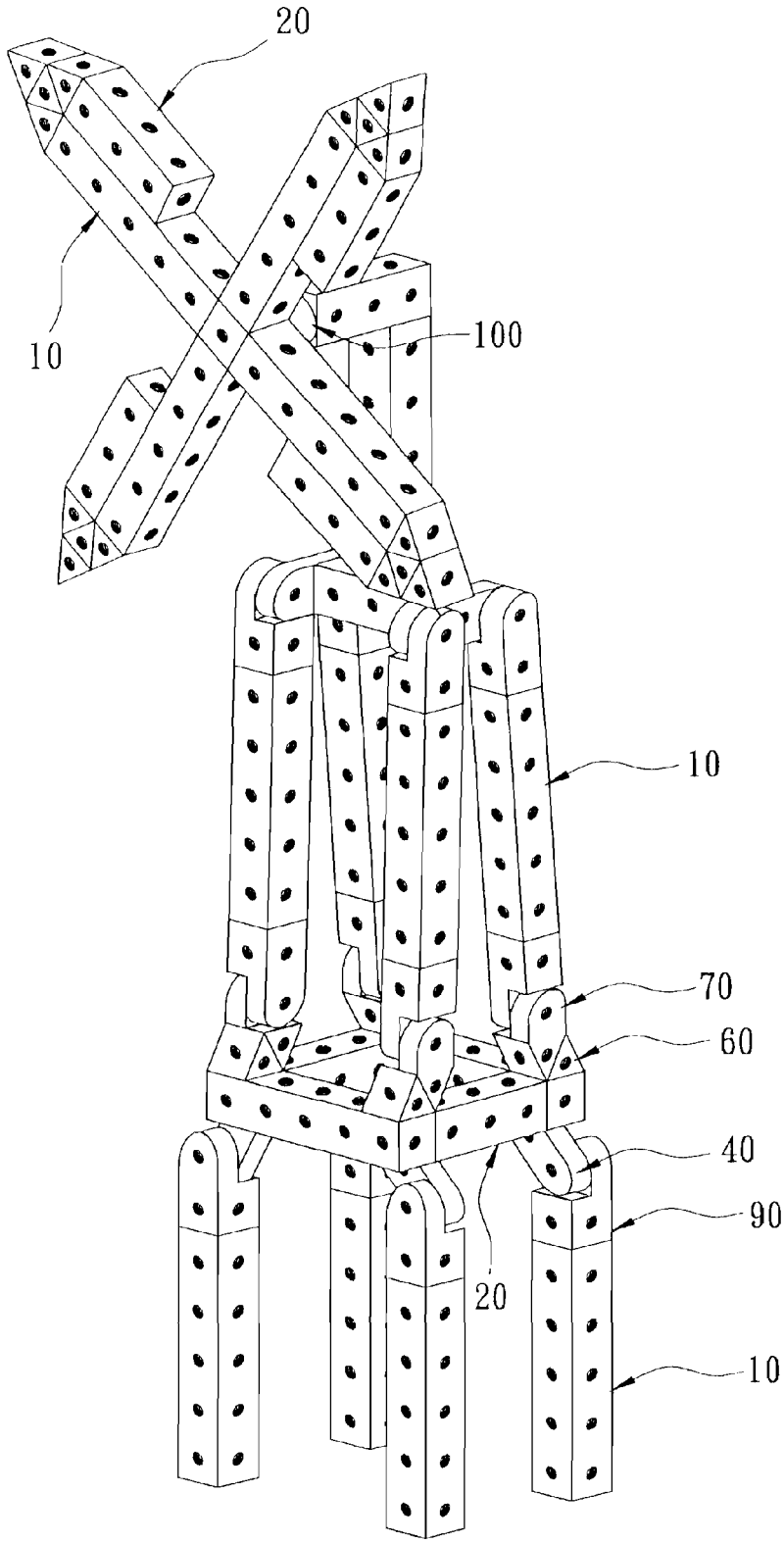
FIG. 5 shows another assembled perspective view of the preferred embodiment of the present invention, showing a toy that can be assembled.

Referring to FIG. 5, multiple first blocks 10, second blocks 20, fourth blocks 40, sixth blocks 60, seventh blocks 70, ninth blocks 90 and tenth blocks 100 can be assembled as a toy by the adapter 110.

Figure 6:
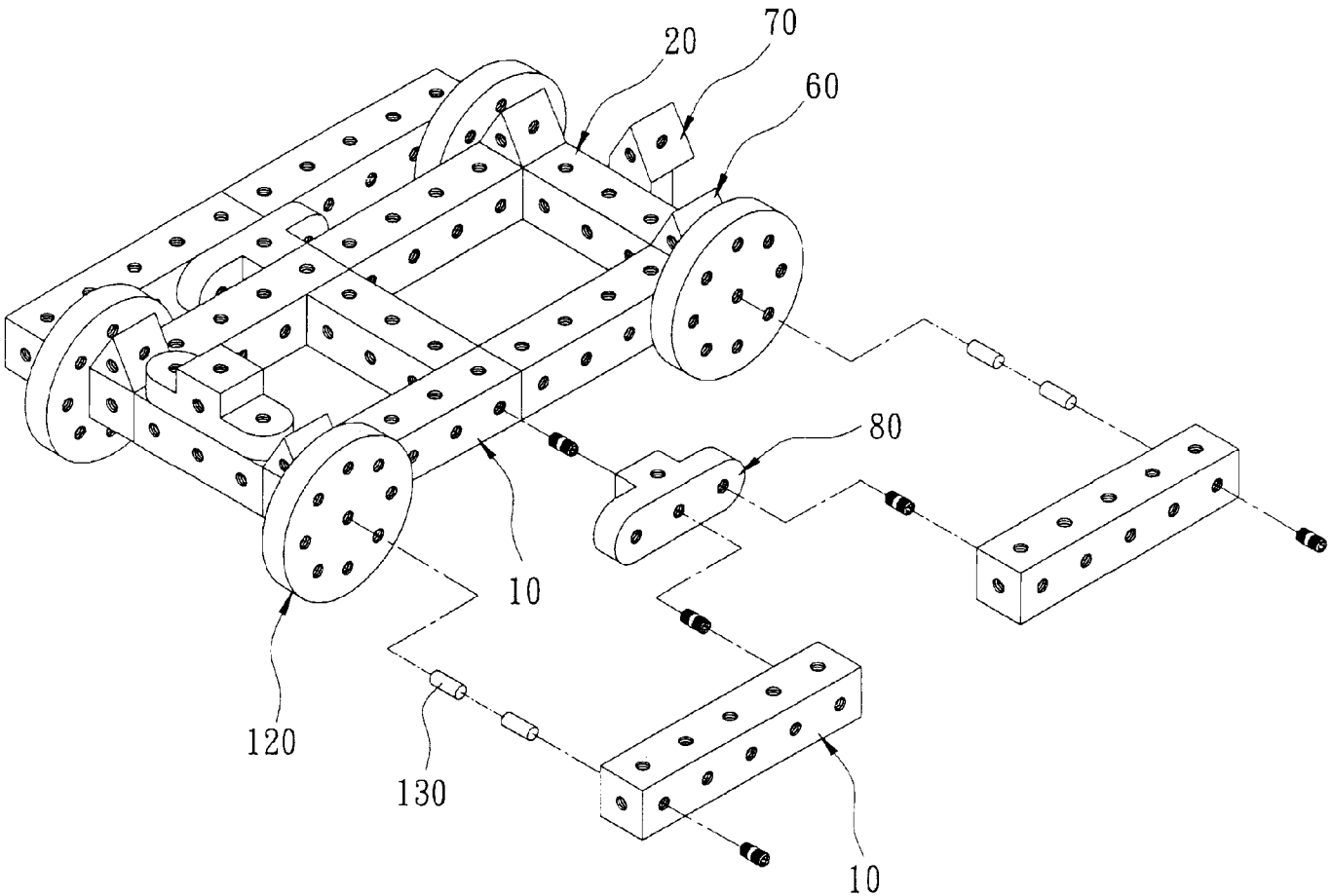
FIG. 6 shows another assembled perspective view of the preferred embodiment of the present invention, showing a movable car toy that can be assembled.

Referring to FIG. 6, multiple first blocks 10, second blocks 20, sixth blocks 60, seventh blocks 70 and eighth blocks 80 are assembled as a carriage by the adapter 110, then multiple disks 120 are hinged between two parallel tap holes 13 of the first block 10 by the hinged arm 130, thus forming a mobile toy car.

Figure 8:
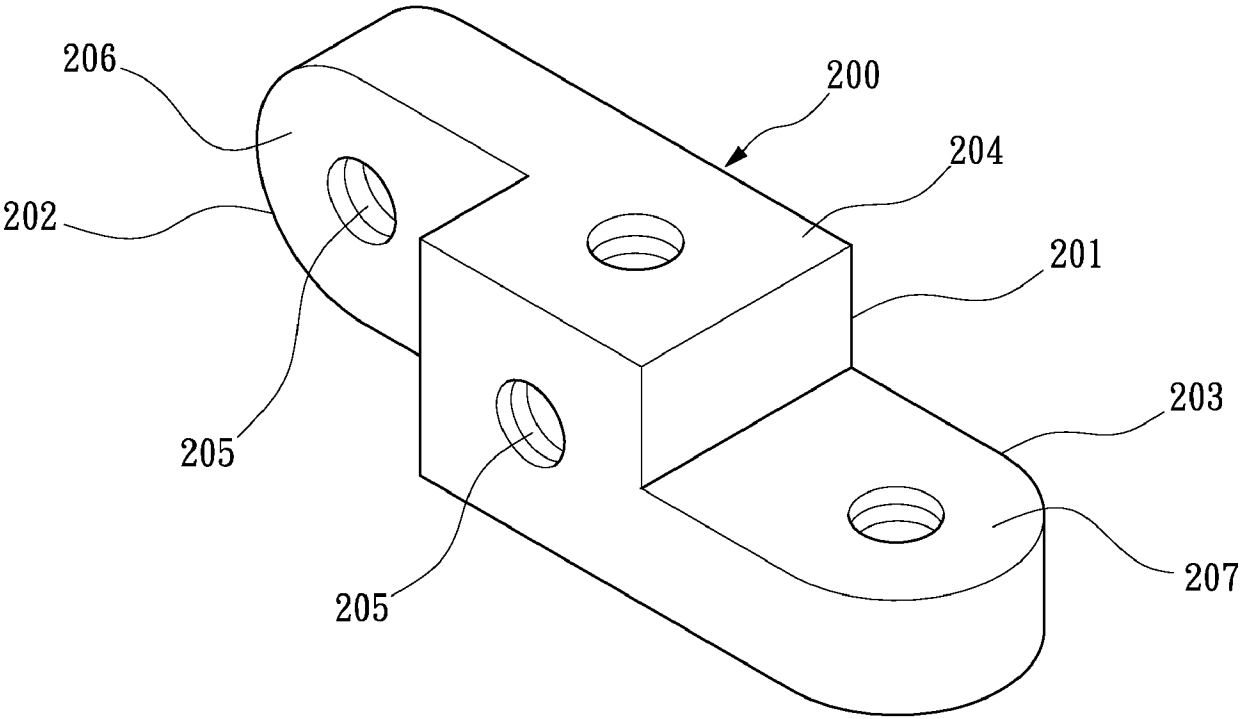
FIG. 8 shows another partially perspective view of the preferred embodiment of the present invention.

Referring to FIG. 8, there is an L-shaped composite eleventh block 200, which is provided with a square portion 201, a longitudinal arched portion 202 linked oppositely to the square portion 201, as well as a transverse arched portion 203. The square portion 201 is provided with 6 square side faces 204 interlinked vertically. The square side face 204 not linked to the longitudinal and transverse arched portions 202, 203 is provided with a tap hole 205. Both the longitudinal and transverse arched portions 202, 203 are provided with 2 arched side faces 206, 207 arranged oppositely in parallel. Both the arched side faces 206, 207 are also provided with an interlinked tap hole 205.

Figure 9:
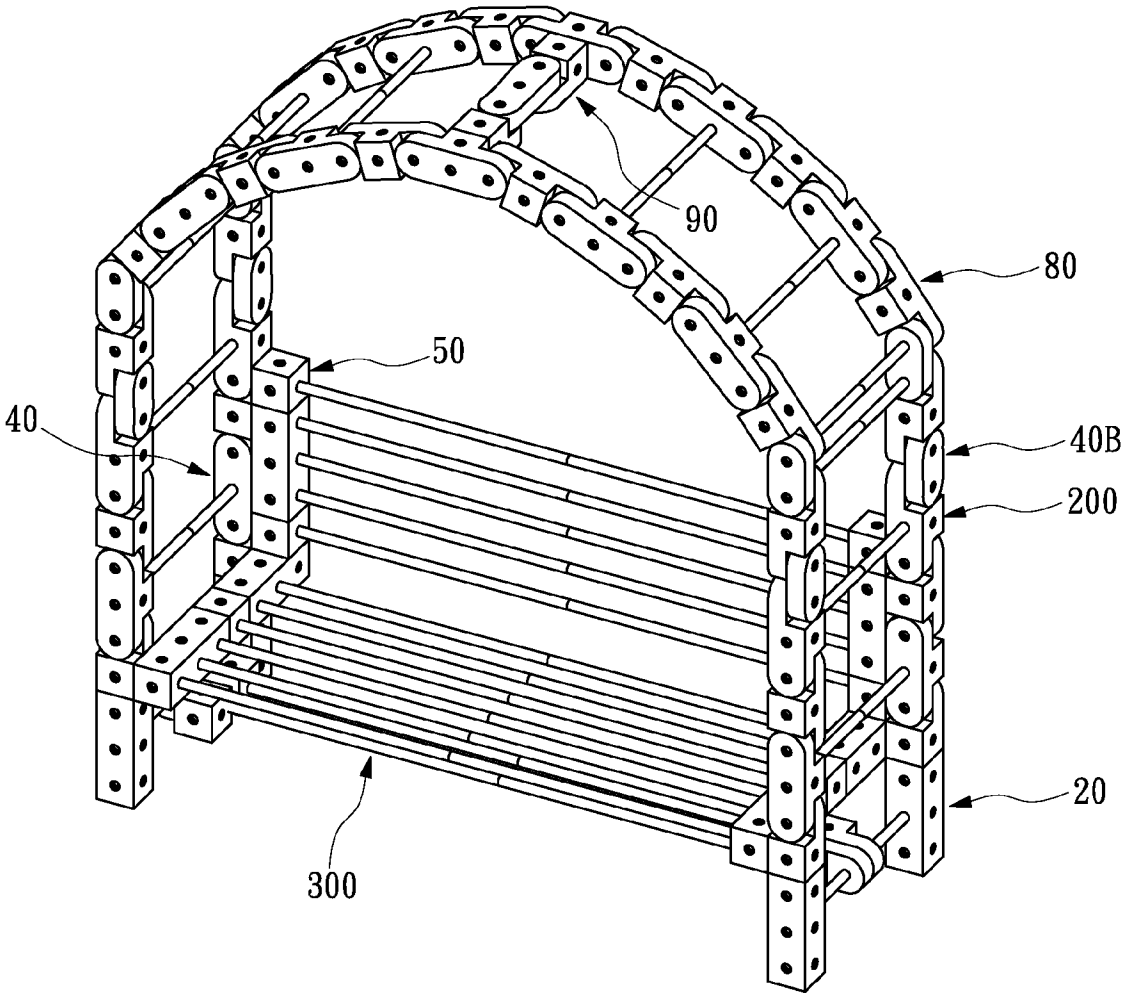
FIG. 9 shows another assembled perspective view of the preferred embodiment of the present invention, showing an arched bench that can be assembled.

Referring to FIG. 9, multiple second blocks 20, fourth blocks 40, fifth blocks 50, eighth blocks 80, ninth blocks 90 and eleventh blocks 200 along with the fourth blocks 40B with 2 tap holes are assembled by the adapter 110 as an arched frame of flexible angle, then a plurality of rods 300 of external diameter equal to the second block 20 are arranged between the corresponding blocks 20, thus forming an arched bench.

Figure 10:
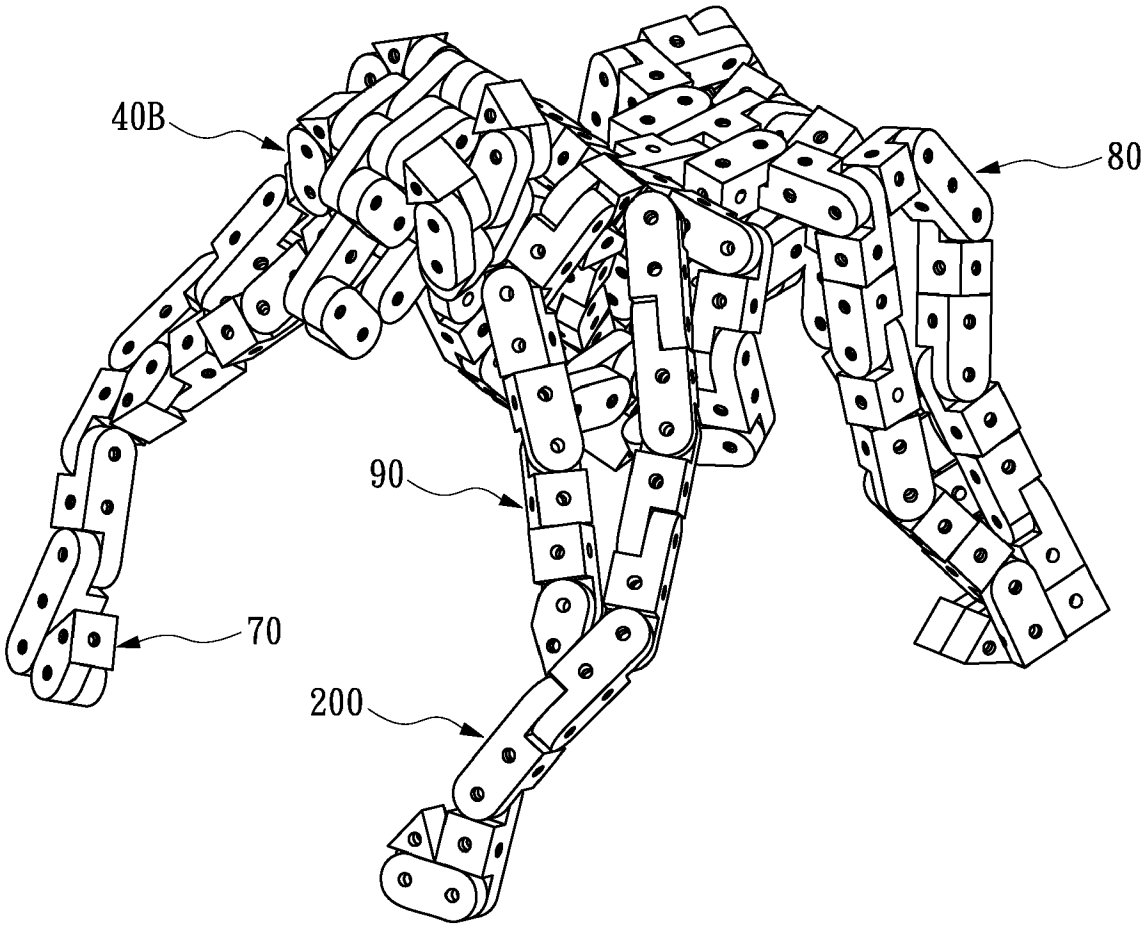
FIG. 10 shows another assembled perspective view of the preferred embodiment of the present invention, showing a baboon toy that can be assembled.

Referring to FIG. 10, multiple seventh blocks 70, eighth blocks 80, ninth blocks 90 and eleventh blocks 200 along with the fourth blocks 40B with 2 tap holes are assembled by the adapter 110 as a baboon-like toy, which has multiple angular variation via the eleventh block 200, thus presenting a flexible visual effect.

Figure 11:
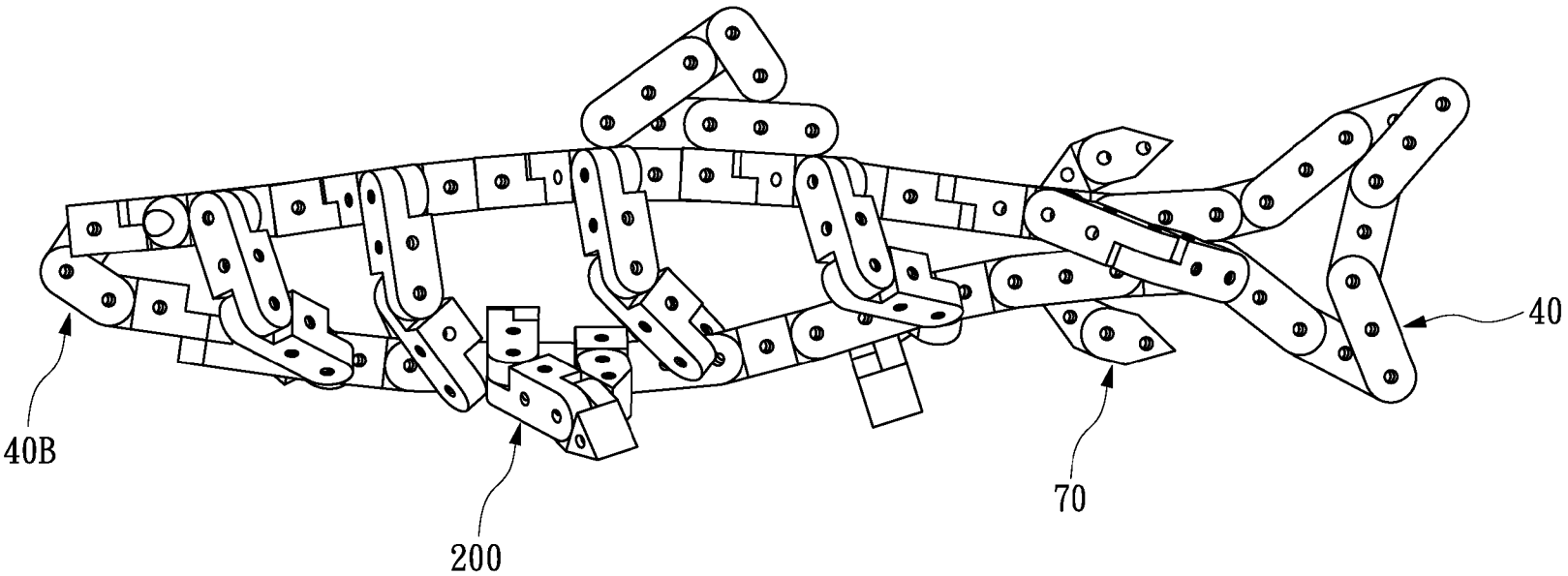
FIG. 11 shows another assembled perspective view of the preferred embodiment of the present invention, showing a fish-like toy that can be assembled.

Referring to FIG. 11, multiple fourth blocks 40, seventh blocks 70 and eleventh blocks 200 along with the fourth blocks 40B with 2 tap holes are assembled by the adapter 110 as a fish-like model, which has a bendable body of abundant arched changes via the eleventh block 200, making it appear like a real object.

In addition to the tables, chairs and toys hereto, the present invention allows the users to assemble into the models of animals, buildings and stationery, where necessary, and disassemble simply and safely by the adapter 110 and operating tool 140.

I claim:

1. A multi-purpose modular assembly comprising:

a plurality of blocks assembled as a polyhedron, each of said plurality of blocks having a first side face and a second side face formed on opposite sides of the block, each of first and second side faces having a first tap hole and a second tap hole embedded therein, each of said first and second tap holes having an edge, a first distance being defined between the edges of said first and second tap holes, a second distance being defined between the edges of the first and second tap holes on parallel side faces of adjoined blocks of said plurality of blocks, the side faces of said plurality of blocks being interlocked together; and a plurality of adapters arranged respectively so as to link said plurality of blocks together, each of said adapters having a first end and a second end opposite to each other along an axial line, the adapter having an intermediate position between said first and second ends thereof, the adapter having a first thread portion formed on one side of said intermediate portion and a second threaded portion formed on an opposite side of said intermediate portion, said first threaded portion having a thread threaded in a direction opposite to a thread of said second threaded portion, said first threaded portion engaged with one of said first and second tap hole and said second threaded portion engaged with the other of said first and second tap holes of the adjoined blocks, the adapter having a distance between said first and second ends that is less than said second distance.

2. The multi-purpose modular assembly of claim 1, each of said plurality of blocks having a shape selected from the group consisting of a rectangular block, an arch-shaped board, an elliptical board, a square board, a triangular board, a triangular composite arch-shaped board, a T-shaped block, an L-shaped block, a cylinder, and an L-shaped composite arched block.

3. The multi-purpose modular assembly of claim 1, one of said first and second tap holes on one of said first and second side faces being coaxial with one of said first and second tap holes on the other side face of said first and second side faces.

4. The multi-purpose modular assembly of claim 1, said first and second tap holes of a pair of vertically-linked side faces of the block being interlinked perpendicularly.

5. The multi-purpose modular assembly of claim 1, the adapter having a first hexagonal hole at said first end and a second hexagonal hole at said second end thereof.

6. The multi-purpose modular assembly of claim 1, further comprising:

an operating tool engageable with sthe adapter.

7. The multi-purpose modular assembly of claim 1, further comprising:

a plurality of disks each having a first face and second face opposite to said first face, each of said plurality of disks having a plurality of tap holes formed therein and extending between said first and second faces, the adapter connecting the disk to the block.

8. The multi-purpose modular assembly of claim 7, further comprising:

a plurality of hinged arms rotatably received respectively by said plurality of disks or by the respective tap holes of the block, the hinged arm having a smooth external surface.

* * * * *